US011462377B2

(12) United States Patent
Kieffel et al.

(10) Patent No.: US 11,462,377 B2
(45) Date of Patent: Oct. 4, 2022

(54) ELECTRIC ARC-BLAST NOZZLE MADE OF A MATERIAL COMPRISING MICRO-CAPSULES OF LIQUID (CF3)2CFCN AND A CIRCUIT BREAKER INCLUDING SUCH A NOZZLE

(71) Applicant: General Electric Technology GmbH, Baden (CH)

(72) Inventors: Yannick Kieffel, Villeurbanne (FR); François Biquez, Villeurbanne (FR)

(73) Assignee: General Electric Technology Gmbh, Baden (CH)

( * ) Notice: Subject to any disclaimer, the term of this patent is extended or adjusted under 35 U.S.C. 154(b) by 0 days.

(21) Appl. No.: 17/274,074

(22) PCT Filed: Sep. 7, 2018

(86) PCT No.: PCT/EP2018/074222
§ 371 (c)(1),
(2) Date: Mar. 5, 2021

(87) PCT Pub. No.: WO2020/048621
PCT Pub. Date: Mar. 12, 2020

(65) Prior Publication Data
US 2021/0398762 A1 Dec. 23, 2021

(51) Int. Cl.
*H01H 33/70* (2006.01)

(52) U.S. Cl.
CPC .... *H01H 33/7023* (2013.01); *H01H 33/7076* (2013.01)

(58) Field of Classification Search
CPC ..... H01H 33/7023; H01H 33/7076; H01H 33/22; H01H 33/78; H01H 33/901; H01H 2033/566
(Continued)

(56) References Cited

U.S. PATENT DOCUMENTS 5,828,026 A * 10/1998 Bruhl ..... H01H 33/76 218/150
5,925,863 A * 7/1999 Zehnder ..... H01H 33/7023 218/72
(Continued)

FOREIGN PATENT DOCUMENTS

DE 19517540 A1 11/1996
EP 2 658 054 A1 10/2013
(Continued)

OTHER PUBLICATIONS

Search Report and Written Opinion issued in PCT/EP2018/074222, dated Dec. 21, 2018, 15 pages.

*Primary Examiner* — William A Bolton
(74) *Attorney, Agent, or Firm* — Eversheds Sutherland (US) LLP

(57) ABSTRACT

The invention relates to an electric arc-blast nozzle (5) for a circuit breaker comprising a middle portion (7) forming a throat defining internally an axial passage (13) for interrupting an electric arc, and two end portions (9, 11) extending on either side of the middle portion (7) and being designed to receive respective arcing contacts (1) and (3) that are movable axially relative to each other.

The middle portion (7) and the two end portions (9, 11) are made of a same dielectric material obtained from a composition comprising a fluorocarbon polymer matrix, at least one inorganic filler and micro-capsules of liquid heptafluoro-iso-butyronitrile.

The invention also relates to a circuit breaker including such a nozzle (5).

13 Claims, 2 Drawing Sheets

(58) Field of Classification Search
USPC ..... 218/53, 62, 63, 72, 55
See application file for complete search history.

(56) References Cited

U.S. PATENT DOCUMENTS

| | | | | |
|---|---|---|---|---|
| 6,483,064 | B2 * | 11/2002 | Dufournet | H01H 33/703 218/43 |
| 6,744,000 | B1 * | 6/2004 | Bergmann | H01H 33/98 218/63 |
| 8,859,924 | B2 * | 10/2014 | Yeon | H01H 33/904 218/43 |
| 9,837,230 | B2 * | 12/2017 | Bujotzek | H01H 33/6661 |
| 9,837,801 | B2 * | 12/2017 | Kieffel | H01F 38/20 |
| 10,236,146 | B2 * | 3/2019 | Vigouroux | H01H 33/22 |
| 2018/0204694 | A1 | 7/2018 | Vigouroux et al. | |
| 2019/0214207 | A1 * | 7/2019 | Ledru | H01H 33/7023 |

FOREIGN PATENT DOCUMENTS

| | | | |
|---|---|---|---|
| WO | 2014/037566 | A1 | 3/2014 |
| WO | 2015/040069 | A1 | 3/2015 |

* cited by examiner

ELECTRIC ARC-BLAST NOZZLE MADE OF A MATERIAL COMPRISING MICRO-CAPSULES OF LIQUID (CF3)2CFCN AND A CIRCUIT BREAKER INCLUDING SUCH A NOZZLE

CROSS-REFERENCE TO RELATED APPLICATION

This application is a U.S. National Stage Application under 35 U.S.C. 371 and claims the priority benefit of International Application No. PCT/EP2018/074222, filed Sep. 7, 2018, which is incorporated herein by reference.

TECHNICAL FIELD

The invention relates to the field of electrical insulation and electric arc extinction in high- or medium-voltage equipment.

More particularly, the present invention relates to a nozzle for blowing out an electric arc, this nozzle being designed to be incorporated either in a medium-voltage circuit breaker or in a high-voltage circuit breaker.

Above and below, the expression "medium voltage" is used in the conventionally accepted manner, i.e. the term "medium voltage" refers to a voltage that is greater than 1000 V for AC or greater than 1500 V for DC, but that does not exceed 52,000 V for AC, or 75,000 V for DC.

In addition, the expression "high voltage" is used in the conventionally accepted manner, i.e. the expression "high voltage" refers to a voltage that is strictly greater than 52,000 volts (V) for alternating current (AC) and 75,000 volts for direct current (DC).

The invention also relates to a medium-voltage or a high-voltage circuit breaker fitted with such an electric arc-blast nozzle.

PRIOR ART

An arc-blast circuit breaker comprises at least two arcing contacts that are movable axially relative to each other, between an open position of the circuit breaker in which the arcing contacts are separated from each other and a closed position of the circuit breaker in which the arcing contacts are in contact with each other; an electric arc-blast nozzle; and an arc-control gas flowing in the nozzle in order to interrupt an electric arc that is likely to form during movement of the arcing contacts from the closed position to the open position of the circuit breaker.

A conventional electric arc-blast nozzle that is, in general, made of pure polytetrafluoroethylene (PTFE) or of PTFE with inorganic filler (one speaks of "filled PTFE"), comprises the following portions:

- a middle portion forming a throat defining internally an axial passage for breaking an electric arc, and
- two end portions extending on either side of the middle portion and being designed to receive respective arcing contacts that are movable axially relative to each other, between an open position of the circuit breaker in which the arcing contacts are separated from each other and a closed position of the circuit breaker in which the arcing contacts are in contact with each other and in which one of the arcing contacts partially closes the axial passage of the middle portion, an arc-control gas flowing through the axial passage of the middle portion in order to interrupt an electric arc that is likely to form during movement of the arcing contacts from the closed position to the open position of the circuit breaker.

In order to interrupt an electric arc, an arc-blast circuit breaker uses an arc-control gas formed by an insulating dielectric gas. This arc-control gas is delivered from a blast chamber into the axial passage of the middle portion of an above-described electric arc-blast nozzle. Such a nozzle has the function of channeling the electric arc and, by doing so, of increasing the pressure of the arc-control gas in the vicinity of the electric arc, thus promoting arc extinction.

In addition to the dielectric gas blasted onto the arc, the ablation of the PTFE nozzle is used to increase the pressure build-up into the arcing chamber. The interaction between the arc radiation and PTFE nozzle materials, especially its filler, creates PTFE vapors which helps extinguishing the arc.

Currently, the most frequently-used arc-control gas for that type of circuit breakers is sulfur hexafluoride $SF_6$ because of the exceptional physical properties of said gas. However, $SF_6$ has the major disadvantage of presenting a global warming potential (GWP) of 23 500 (relative to carbon dioxide ($CO_2$) over 100 years) and a time period spent in the atmosphere of 3200 years, which places it among very strong greenhouse gases. $SF_6$ was thus added by the Kyoto Protocol (1997) to the list of gases for which emissions must be limited.

The best way to limit $SF_6$ emissions consists in limiting the use of said gas, and that has led industry to seek alternatives to $SF_6$.

To that end, a new gas presenting electrical insulation properties that are sufficient for an application in the field of high- or medium-voltage equipment has been developed. More precisely, that gas is a mixture of two molecules: one is present in a great majority and the second is heptafluoro-iso-butyronitrile and is present in a smaller amount. This gas mixture has the advantage of being based on an $SF_6$ substitute presenting a GWP that is less than that of $SF_6$ in solution in a host or dilution gas having a very low GWP, such as $CO_2$ having a GWP that is equal to 1, or of GWP that is zero, such as for nitrogen ($N_2$) or air.

International application WO 2014/037566 [1] describes the use of such mixtures as an insulation gas in high- or medium-voltage equipment, associated with solid insulation. A particular insulation gas, namely comprising or even consisting of heptafluoro-iso-butyronitrile, carbon dioxide, and oxygen, oxygen being present in said gas medium in a molar percentage lying in the range 1% to 25%, is described in international application WO 2015/040069 [2]. Below, the expression "$g^3$ gas" (for "green gas for grid" gas) designates any mixture of 2 molar percent (mol %) to 15 mol % heptafluoro-iso-butyronitrile, 60 mol % to 98 mol % carbon dioxide and 0 to 25 mol % oxygen.

The dielectric gas is usually degraded due to the arc energy and temperature which is above 10,000 K (9,726.85° C.). When the arc-control gas is $SF_6$, the latter is ionized in S and F ions and regenerates partly from plasma when the temperature goes down. Nevertheless, the regeneration is not at 100% as the gas can include some contaminants such as oxygen or hydrogen from air and/or humidity but also metal vapor from arcing contact and carbon from PTFE nozzle. Then by reaction with humidity and oxygen by-products are generated such as $SO_2$, $SO_2F_2$, $CF_n$ (reaction with carbon from PTFE nozzle) or $MF_n$ (reaction with metal vapor from arcing contacts). The $SF_6$ decomposition diagram follows:

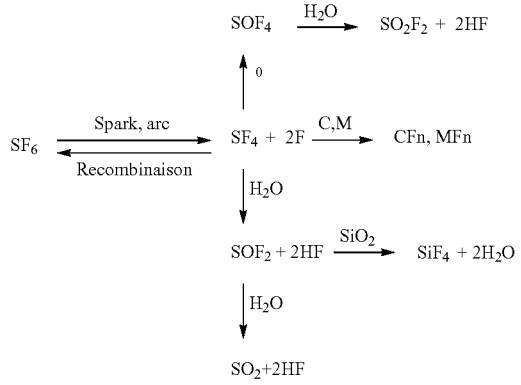

As a main result, the $SF_6$ content slightly decreases with arc interruption occurrence. Nevertheless, as $SF_6$ is pure, the degradation as no significant impact on the interruption capability of the circuit breaker. In fact, the $SF_6$ breaker is designed in accordance with the $SF_6$ purity degradation.

Inside a circuit breaker in which the arc-control gas is $g^3$ gas, arcing induces a partial decomposition of $CO_2$ and heptafluoro-iso-butyronitrile which will not regenerate, by opposition to $SF_6$. The content of heptafluoro-iso-butyronitrile will therefore decrease with arc interruption occurrence what could impact the dielectric strength of the gas. In other words, the $g^3$ gas is more sensitive than $SF_6$ to degradation from the arc.

The patent EP 2 658 054 proposes to solve such a technical problem by an invention based on liquid/vapor equilibrium. Indeed, the arc-control gas implemented in this prior art is a fluoroketone and it is proposed to use a liquid phase of fluoroketone to regenerate by evaporation a gas component with a high dielectric strength. In that solution, the liquid phase is used as a buffer that will evaporate when the partial pressure of the component decreases.

Nevertheless, this solution is not widely accepted today in Gas Insulated Switchgear (GIS) as the liquefaction of the gas is not accepted by all customers. The liquid/vapor equilibrium is mostly influenced by the temperature. The heptafluoro-iso-butyronitrile will evaporate more in high temperatures and this will increase the density of the gas, making difficult the control of the tightness during the service life of the equipment. Liquefaction will lower the gas density what could be interpreted as a gas leak by gas densimeter and generate false alarm. This must be specifically mastered.

The invention therefore aims to propose a novel electric arc-blast nozzle that enables the drawbacks of prior art electric arc-blast nozzles to be mitigated.

In particular, this new nozzle must be suitable for fitting to a circuit-breaker in which the arc-control gas is a mixture comprising heptafluoro-iso-butyronitrile, $CO_2$ and optionally oxygen such as $g^3$ gas. Such a circuit-breaker is to cure the sensitivity of gas comprising heptafluoro-iso-butyronitrile, $CO_2$ and optionally oxygen such as $g^3$ gas to degradation from the arc.

The new nozzle must also be suitable for fitting to such a circuit breaker without any increase in its bulk and without any noticeable increase in costs, namely in terms of manufacturing process.

SUMMARY OF THE INVENTION

The above-mentioned aims as well as others are achieved, firstly, by an electric arc-blast nozzle for a circuit breaker of the above-mentioned type, i.e. by a nozzle comprising:

a middle portion forming a throat defining internally an axial passage for breaking an electric arc, and two end portions extending on either side of the middle portion and being designed to receive respective arcing contacts that are movable axially relative to each other, between an open position of the circuit breaker in which the arcing contacts are separated from each other and a closed position of the circuit breaker in which the arcing contacts are in contact with each other and in which one of the arcing contacts partially closes the axial passage of the middle portion, an arc-control gas flowing through the axial passage of the middle portion in order to interrupt an electric arc that is likely to form during movement of the arcing contacts from the closed position to the open position of the circuit breaker.

According to the invention, the middle portion together with the two end portions of the nozzle are made of a same dielectric material, such a dielectric material being obtained from a composition comprising a fluorocarbon polymer matrix, at least one inorganic filler and micro-capsules of liquid heptafluoro-iso-butyronitrile.

In a specific embodiment, this composition consists of a fluorocarbon polymer matrix, of one or more inorganic filler(s) and of micro-capsules of liquid heptafluoro-iso-butyronitrile.

The choice of the particular composition, which comprises a fluorocarbon polymer matrix, at least one inorganic filler and micro-capsules of liquid heptafluoro-iso-butyronitrile, for the dielectric material of the middle portion and the two end portions of the nozzle makes it possible to have a heptafluoro-iso-butyronitrile source into the breaker to compensate its degradation in the arc-control gas originated from the arc interruption.

More particularly, the micro-capsules of liquid heptafluoro-iso-butyronitrile that act as a heptafluoro-iso-butyronitrile reservoir present in the nozzle, progressively releases this heptafluoro-iso-butyronitrile into the environment surrounding the electric arc under the ablation of the dielectric material caused by the intense radiation from this electric arc. Such a heptafluoro-iso-butyronitrile release allows a continuous input of gaseous heptafluoro-iso-butyronitrile in the arc-control gas.

Indeed, during the arc interruption, the energy generated from the arc initiates the ablation of the inner side of the nozzle i.e. in contact with the arc radiation which breaks the polymeric shell of the micro-capsules and make free the heptafluoro-iso-butyronitrile at gaseous state due to the high temperature. Into the nozzle, the heptafluoro-iso-butyronitrile remains as a liquid due to the pressure from the fluorocarbon polymer matrix.

It should be noted that the presence of the micro-capsules of liquid heptafluoro-iso-butyronitrile in the material forming the nozzle does not affect the good mechanical properties, good insulating properties and the good high-temperature behavior of the electric arc-blast nozzle.

It is advantageously possible to envisage manufacturing, as one single part, the assembly formed by the middle portion and the two end portions. This manufacturing can be performed by molding or by sintering the particular composition implemented in the invention.

As a reminder, the heptafluoro-iso-butyronitrile of formula $(CF_3)_2CFCN$ corresponds to 2,3,3,3-tetrafluoro-2-trifluoromethyl propanenitrile and has CAS number: 42532-60-5.

In the context of the present invention, the term "micro-capsules of liquid heptafluoro-iso-butyronitrile" means that liquid heptafluoro-iso-butyronitrile is encapsulated in shells and in particular in polymeric shells, the mean diameter of which is below 1 mm, notably is comprised between 10 μm and 900 μm and, in particular, between 50 μm and 800 μm.

The preparation of micro-capsules containing heptafluoro-iso-butyronitrile is based on micro-encapsulation technology usually used today in the food industry, self-healing materials and cosmetic. Different protocols well-known to the one skilled in the art can be implemented for this preparation. One can cite spray drying, extrusion, centrifugal extrusion, two-fluid extrusion and vapor phase deposition.

As illustrative and non-limiting examples of the polymer usable to form the shell of the micro-capsules containing heptafluoro-iso-butyronitrile, on can cite polytetrafluoroethylene, polyethylene, polystyrene, urea-formaldehyde, polyurethane, 1H,1H,2H,2H-perfluorodecyl acrylate cross-linked with ethylene glycol diacrylate, starch, maltodextrin, arabic gum, gelatin, polyvinyl alcohol, ethyl cellulose and sodium alginate.

Depending on the micro-encapsulation protocol implemented to prepare the micro-capsules containing heptafluoro-iso-butyronitrile, the latter can be used in a gaseous form or in a liquid form or even can be liquefied during the micro-encapsulation protocol. Whether the heptafluoro-iso-butyronitrile is gaseous or liquid in the micro-capsules thus prepared, it will be or become liquid in the composition comprising the fluorocarbon polymer matrix, as already explained.

In the particular composition from which the middle portion and the two end portions of the electric arc-blast nozzle are obtained, the micro-capsules containing liquid heptafluoro-iso-butyronitrile are in a proportion by weight lying in the range 0.1% to 30%, relative to the total weight of the composition.

It should be noted that, in the highest values of said range, the density of the micro-capsules inside the fluorocarbon polymer matrix is such that, inside the plasma, the density of gaseous heptafluoro-iso-butyronitrile can locally increase. This is beneficial for breaking and insulation performances, without increasing significantly the global % of heptafluoro-iso-butyronitrile, due to dilution effect in the whole volume of the breaker.

The particular composition from which the middle portion and the two end portions of the electric arc-blast nozzle are obtained also comprises one or more inorganic filler(s). The one skilled in the art knows different types of inorganic fillers usually present in the material for an electric arc-blast nozzle.

This or these inorganic filler(s) may be selected from the group consisting of oxides, fluorides, sulfides, graphite, mica, glass, ceramics and mixtures thereof.

As particular examples of oxides which can be used as inorganic fillers in the composition implemented in the present invention, one can cite manganese oxide ($MnO_2$), cobalt oxide ($CoO$, $CoO_2$), copper oxide ($CuO$), vanadium pentoxide ($V_2O_5$), nickel oxide ($NiO$), iron oxide ($Fe_2O_3$), rhodium oxide ($Rh_2O_3$), ruthenium oxide ($RuO_2$), tin oxide ($SnO_2$), molybdenum oxide ($MoO_2$), titanium dioxide ($TiO_2$), aluminium oxide ($Al_2O_3$), cobalt aluminum oxide ($Al_2CoO_4$), niobium(III) oxide ($Nb_2O_3$), barium titanate ($BaTiO_3$), silicon dioxide ($SiO_2$), phosphorus oxide (V) ($P_2O_5$), zinc oxide ($ZnO$) and bismuth oxide ($Bi_2O_3$).

As particular example of fluorides which can be used as inorganic fillers in the composition implemented in the present invention, one can cite calcium fluoride ($CaF_2$).

As particular examples of sulfides which can be used as inorganic fillers in the composition implemented in the present invention, one can cite calcium fluoride molybdenum disulfide ($MoS_2$), antimony pentasulfide ($Sb_2S_5$) and stibnite ($Sb_2S_3$).

As particular example of ceramics which can be used as inorganic fillers in the composition implemented in the present invention, one can cite boron nitride (BN).

In the particular composition from which the middle portion and the two end portions of the electric arc-blast nozzle are obtained, the inorganic filler(s) are advantageously selected in the group consisting of $MoO_2$, $TiO_2$, $SiO_2$, $CaF_2$ and $MoS_2$.

In the particular composition from which the middle portion and the two end portions of the electric arc-blast nozzle are obtained, the inorganic filler(s) is/are in a proportion by weight lying in the range 0.1% to 30%, relative to the total weight of the composition.

The dielectric material that forms the middle portion and the two end portions of the electric arc-blast nozzle is obtained from a composition comprising a fluorocarbon polymer matrix, at least one inorganic filler and micro-capsules of liquid heptafluoro-iso-butyronitrile.

In the context of the present invention, the term "matrix" means that the fluorocarbon polymer constitutes the compound having a proportion by weight, in the composition under consideration that is in the majority. This proportion by weight is advantageously at least 50% and, preferably, at least 75%, relative to the total weight of the composition. As a consequence, in the dielectric material obtained from said composition, the micro-capsules containing liquid heptafluoro-iso-butyronitrile and the inorganic filler are dispersed in the fluorocarbon polymer matrix.

The fluorocarbon polymer of this composition may be selected from the group consisting of a polytetrafluoroethylene (PTFE), a perfluoroalkoxy (PFA), a fluorinated ethylene propylene (FEP), a vinylidene polyfluoride (PVDF) and a copolymer of ethylene and of tetrafluoroethylene (ETFE).

Advantageously, this fluorocarbon polymer is a polytetrafluoroethylene (PTFE).

In an advantageous embodiment, the nozzle of the invention may further comprise a sheath disposed on the outside surface of each of the two end portions and on the outside surface of the middle portion forming a throat.

Such a sheath may in particular make it possible to provide the connection between the movable portions of a circuit breaker fitted with a nozzle of the invention.

By way of example, such a sheath may be put into place by machining, by molding, or also by overmolding on the end portions and on the middle portion that form the nozzle.

This sheath is advantageously made out of a second dielectric material also presenting good mechanical properties and good high-temperature behavior.

The second dielectric material of the sheath may be obtained from a second composition comprising a polymer matrix.

This second composition may comprise a fluorocarbon polymer such as a polytetrafluoroethylene (PTFE), a vinylidene polyfluoride (PVDF) or a copolymer of ethylene and of tetrafluoroethylene (ETFE).

This second composition may also comprise another polymer, e.g. a polyetheretherketone (PEEK), a polysulfone (PSU), a polyphenylsulfone (PPSU), a polyimide (PI) or a polyetherimide (PEI).

This second composition may also include one or more inorganic filler(s).

When they are present, the inorganic filler(s) conventionally represent a proportion by weight that can be up to 10% of the total weight of the second composition, this proportion by weight more generally lying in the range 0.01% to 5% relative to the total weight of the second composition.

Such fillers may be any fillers already mentioned for the particular composition used to prepare the dielectric material of the middle portion and the two end portions of the nozzle according to the invention.

In an embodiment, the thickness of the sheath may represent up to 150% of the radius of the nozzle as measured at the middle portion. This sheath thickness advantageously lies in the range 50% to 100% and, preferably, in the range 70% to 80% of the radius of the nozzle as measured at the middle portion.

In an advantageous embodiment, both of the arcing contacts of the nozzle of the invention may be movable.

In another advantageous embodiment, the nozzle of the invention may further comprise a cap that surrounds the arcing contact located in the upstream end portion relative to the flow direction of the arc-control gas.

This cap is preferably made of the same dielectric material than the dielectric material that forms the middle portion and the two end portions of the electric arc-blast nozzle of the invention.

The invention provides, secondly, a medium- or high-voltage circuit breaker of the type comprising:

- at least two arcing contacts that are movable axially relative to each other, between an open position of the circuit breaker in which the arcing contacts are separated from each other and a closed position of the circuit breaker in which the arcing contacts are in contact with each other;
- an electric arc-blast nozzle; and
- an arc-control gas flowing through the axial passage of the middle portion of the nozzle in order to interrupt an electric arc that is likely to form during movement of the arcing contacts from the closed position to the open position of the circuit breaker.

According to the invention, the nozzle for blowing out an electric arc of such a circuit breaker is as defined above, i.e. the middle portion together with the two end portions of this nozzle are made of a same dielectric material, such a dielectric material being obtained from a composition comprising a fluorocarbon polymer matrix, at least one inorganic filler and micro-capsules of liquid heptafluoro-iso-butyronitrile.

The above-described advantageous characteristics for the arc-blast nozzle as part of the circuit breaker of the invention may naturally be taken alone or in combination.

The choice of the particular dielectric material for the middle portion and the two end portions of the arc-blast nozzle makes it possible to obtain a noticeable improvement in the electrical endurance of the circuit breaker of the invention, especially when the arc-control gas implemented in the circuit breaker of the invention comprises heptafluoro-iso-butyronitrile in a mixture with a dilution gas.

Advantageously said dilution gas is selected from carbon dioxide, nitrogen, oxygen, air, and any mixture thereof.

In particular, this arc-control gas may be the arc-control gas $g^3$ as defined in the present invention i.e. a mixture of 2 molar percent (mol %) to 15 mol % heptafluoro-iso-butyronitrile, 60 mol % to 98 mol % carbon dioxide and 0 to 25 mol % oxygen. More particularly, any mixture disclosed in [1] or [2] can be used as arc-control gas in the medium- or high-voltage circuit breaker of the invention.

The present invention also concerns a method for releasing heptafluoro-iso-butyronitrile into the arc-control gas of a medium- or high-voltage circuit breaker in use, said arc-control gas comprising heptafluoro-iso-butyronitrile in a mixture with a dilution gas, wherein said method consists in implementing a coating formed by a dielectric material obtained from a composition comprising a fluoropolymer matrix, at least one inorganic filler and microcapsules of liquid heptafluoro-iso-butyronitrile inside said medium- or high-voltage circuit breaker.

Other advantages and characteristics of the invention appear on reading the detailed description below, which relates to an arc-blast nozzle structure according to the invention.

This detailed description, which in particular makes reference to accompanying FIGS. 1 to 3, is given by way of illustration and in no way constitutes a limitation on the subject-matter of the invention.

BRIEF DESCRIPTION OF THE DRAWINGS

It is stated that the elements shared in FIGS. 1 and 2 are identified by the same reference numbers.

DETAILED DESCRIPTION OF PARTICULAR EMBODIMENTS

Figure 1:
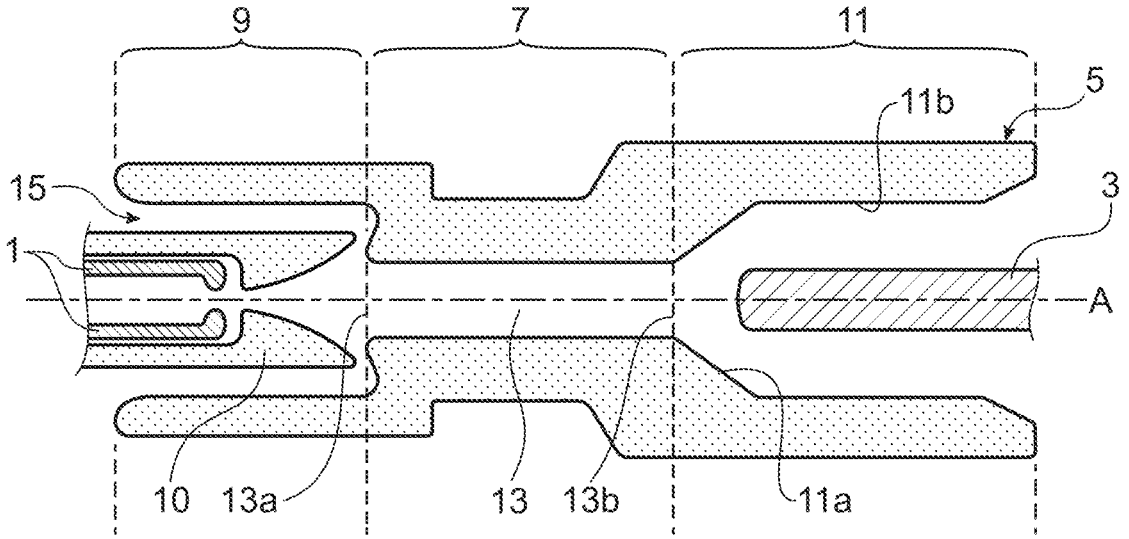
FIG. 1 is a fragmentary and diagrammatic view in longitudinal section of a circuit breaker including an electric arc-blast nozzle of the invention.

FIG. 1 shows a circuit breaker portion. The circuit breaker includes:

- at least two arcing contacts 1 and 3 that are movable axially relative to each other, along an axis A, between an open position of the circuit breaker in which the arcing contacts 1 and 3 are separated from each other and a closed position of the circuit breaker in which the arcing contacts 1 and 3 are in contact with each other; and
- an arc-blast nozzle 5 according to the invention.

This nozzle 5 includes a throat-forming middle portion 7, an end portion 9 disposed upstream and an end portion 11 disposed downstream, the upstream and downstream disposition of the end portions 9 and 11 being relative to the flow direction of the arc-control gas. These two end portions 9 and 11 extend on either side of the middle portion 7. These portions 7, 9 and 11 are circularly symmetrical about the axis A.

The middle portion 7 defines internally an axial arc-control passage 13, said axial passage 13 having an inlet 13*a* and an outlet 13*b*. This middle portion 7 is referred to as the throat-forming middle portion 7, because of the inside sectional area of the axial passage 13, which is smaller than the inside sectional areas of each of the end portions 9 and 11.

The end portions 9 and 11 receive and surround the arcing contacts 1 and 3 respectively.

The end portion 9 disposed upstream makes it possible to channel the arc-control gas situated upstream and intended for blasting the electric arc, whereas the end portion 11 disposed downstream has the function of evacuating and diffusing the gas that has been blasted and that is situated downstream, where upstream and downstream being defined relative to the flow direction of the arc-control gas.

The end portion 9 may also comprise a cap 10 that surrounds the arcing contact 1.

In FIG. 1, the arcing contacts 1 and 3 are separated from each other and therefore correspond to the open position of the circuit breaker.

When the arcing contacts 1 and 3 are in contact with each other, in the closed position of the circuit breaker, the arcing contact 3 partially closes the axial passage 13 of the middle portion 7.

Between the arcing contact 1 and the wall of the end portion 9 there is disposed a delivery channel 15 for conveying the arc-control gas, enabling the gas to flow in the axial passage 13 of the middle portion 7, from its inlet 13*a* until it reaches its outlet 13*b*, in order to extinguish an electric arc likely to form during movement of the arcing contacts 1 and 3 from the closed position to the open position of the circuit breaker.

The end portion 11 includes a frustoconical portion 11*a* extending the middle portion 7 and situated facing the outlet 13*b* of the axial passage 13, this frustoconical portion 11*a* being followed by a cylindrical portion 11*b*.

The throat-forming middle portion 7 together with the cap 10 and the end portions 9 and 11 are made of the same dielectric material. Such a dielectric material is obtained from a particular composition, which comprises a fluorocarbon polymer matrix, at least one inorganic filler and micro-capsules of liquid heptafluoro-iso-butyronitrile.

Figure 2:
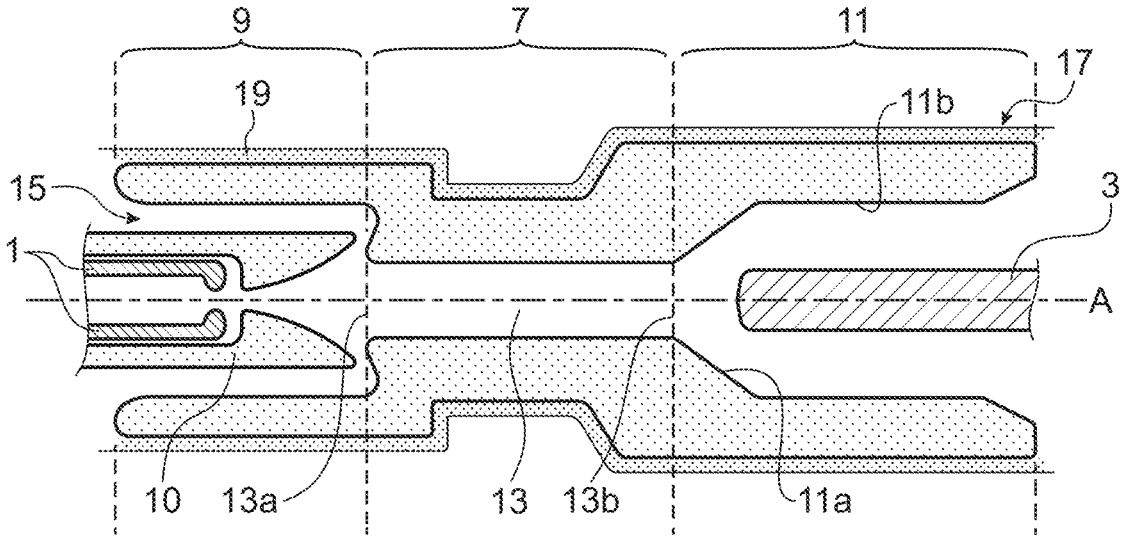
FIG. 2 is a fragmentary and diagrammatic view in longitudinal section of a circuit breaker including an electric arc-blast nozzle of the invention, the nozzle being provided with a sheath.

FIG. 2 shows a nozzle 17 of the invention, which is of the type shown in FIG. 1 and which further comprises a sheath 19 disposed on the outside surface of each of the two end portions 9 and 11 and on the outside surface of the throat-forming middle portion 7.

The sheet 19 is formed from a second dielectric material that also presents good mechanical properties and good high-temperature behavior. Typically, this second dielectric material is obtained from a second composition having a polymer matrix, such as a PTFE matrix, and may include one or more inorganic fillers.

Reference may be made to the summary of the invention for further details about the different variants of this second composition suitable for being envisaged in order to obtain the second dielectric material constituting the sheet 19.

Figure 3A:
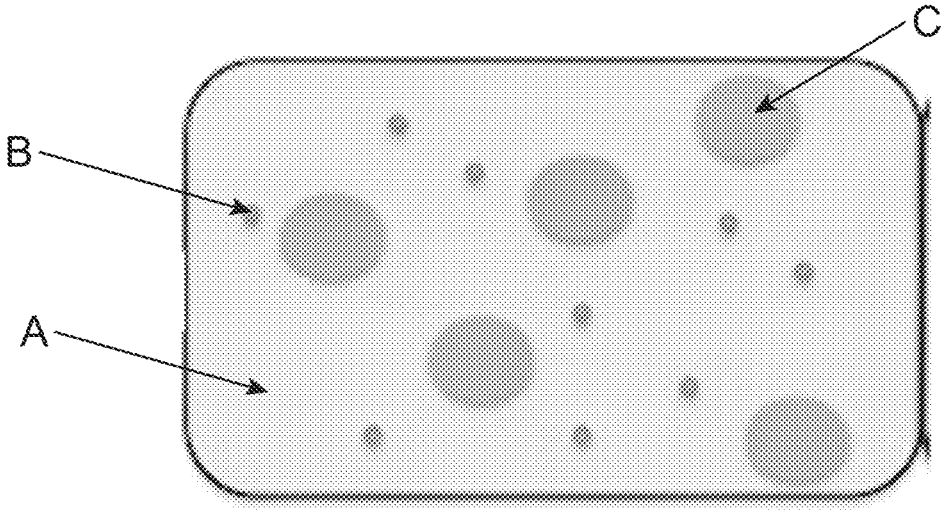
FIG. 3 presents the nozzle material implemented in the invention (FIG. 3A) and its interaction with arc and evaporation process (FIG. 3B).

As already indicated, the throat-forming middle portion 7 together with the cap 10 and the end portions 9 and 11 are made of the same dielectric material. Such a dielectric material is obtained from a particular composition, which comprises a fluorocarbon polymer matrix, at least one inorganic filler and micro-capsules of liquid heptafluoro-iso-butyronitrile. In particular embodiments, this material is obtained from a composition consisting of a fluorocarbon polymer matrix, of at least one inorganic filler and of micro-capsules of liquid heptafluoro-iso-butyronitrile. Such a material is represented at FIG. 3A with A representing the fluorocarbon polymer matrix such as PTFE, B the inorganic fillers and C the micro-capsules of liquid heptafluoro-iso-butyronitrile.

Reference may be made to the summary of the invention for further details about the different variants of this particular composition suitable for being envisaged in order to obtain the dielectric material constituting the middle portion 7 and the end portions 9 and 11 of the nozzle 5.

Figure 3B:
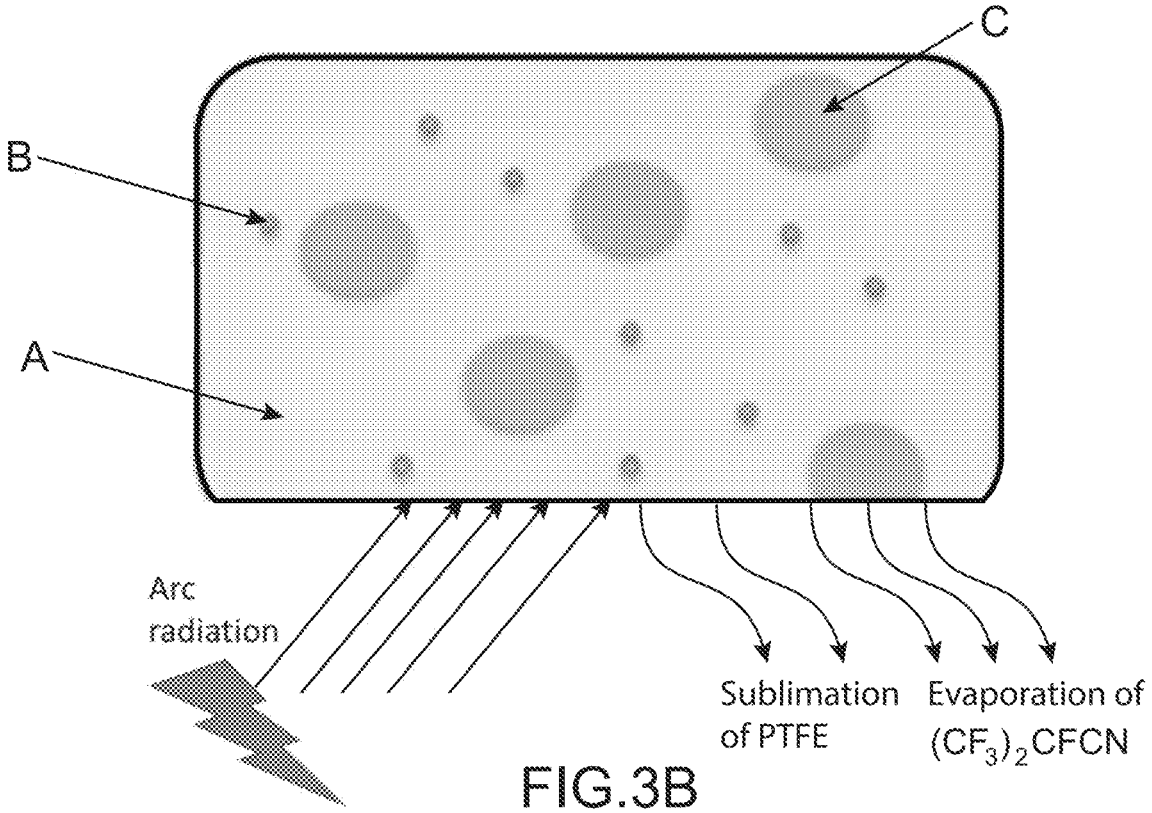

In case of arc, the radiation generates the ablation of the inner surface of the nozzle, to which the portions 11*a* and 11*b* in FIGS. 1 and 2 belong. The radiation of the arc will generate fluorocarbon polymer vapor such as PTFE vapor by sublimation and heptafluoro-iso-butyronitrile evaporation, see FIG. 3B. When the arc-control gas comprises $CO_2$ and heptafluoro-iso-butyronitrile, this evaporation acts as a local source of heptafluoro-iso-butyronitrile and helps keeping constant the heptafluoro-iso-butyronitrile content into the gas phase and therefore contribute to the long term stability of the breaker for arc interruprion and insulation.

BIBLIOGRAPHY

[1] International application WO 2014/037566
[2] International application WO 2015/040069

The invention claimed is:

1. An electric arc-blast nozzle for a circuit breaker, comprising:

a middle portion forming a throat defining internally an axial passage for breaking an electric arc, and two end portions extending on either side of the middle portion and being designed to receive respective arcing contacts that are movable axially relative to each other, between an open position of the circuit breaker in which the arcing contacts are separated from each other and a closed position of the circuit breaker in which the arcing contacts are in contact with each other and in which one of the arcing contacts partially closes the axial passage of the middle portion, an arc-control gas flowing through the axial passage of the middle portion in order to interrupt the electric arc that is likely to form during movement of the arcing contacts from the closed position to the open position of the circuit breaker, the electric arc-blast nozzle being characterized in that the middle portion together with the two end portions are made of a same dielectric material obtained from a composition comprising a fluorocarbon polymer matrix, at least one inorganic filler and micro-capsules of liquid heptafluoro-iso-butyronitrile.

2. The electric arc-blast nozzle according to claim 1, wherein the composition consists of the fluorocarbon polymer matrix, of one or more inorganic filler(s) and of micro-capsules of liquid heptafluoro-iso-butyronitrile.

3. The electric arc-blast nozzle according to claim 1, wherein a proportion by weight of the micro-capsules of liquid heptafluoro-iso-butyronitrile lies in a range 0.1% to 30% relative to a total weight of the composition.

4. The electric arc-blast nozzle according to claim 1, wherein said inorganic filler(s) are selected from a group consisting of oxides, fluorides, sulfides, graphite, mica, glass, ceramics and mixtures thereof.

5. The electric arc-blast nozzle according to claim 1, wherein a proportion by weight of the inorganic filler(s) lies in a range 0.1% to 30% relative to a total weight of the composition.

6. The electric arc-blast nozzle according to claim 1, wherein the fluorocarbon polymer of the composition is selected from a group consisting of a polytetrafluoroethylene, a perfluoroalkoxy, fluorinated ethylene propylene, a vinylidene polyfluoride and a copolymer of ethylene and of tetrafluoroethylene, and is a polytetrafluoroethylene.

7. The electric arc-blast nozzle according to claim 1, further comprising a sheath disposed on a first outside surface of each of the two end portions and on a second outside surface of the middle portion forming the throat.

8. The electric arc-blast nozzle according to claim 1, wherein both of the arcing contacts are movable.

9. The electric arc-blast nozzle according to claim 8, further comprising a cap that surrounds the arcing contact, this cap being made of the same dielectric material than the dielectric material of the middle portion and the two end portions.

10. A medium- or high-voltage circuit breaker comprising:

at least two arcing contacts that are movable axially relative to each other, between the open position of the circuit breaker in which the arcing contacts are separated from each other and the closed position of the circuit breaker in which the arcing contacts are in contact with each other, the electric arc-blast nozzle as defined according to claim 1, and the arc-control gas flowing through the axial passage of the middle portion of the nozzle in order to interrupt the electric arc that is likely to form during movement of the arcing contacts from the closed position to the open position of the circuit breaker.

11. The circuit breaker according to claim 10, wherein the arc-control gas comprises heptafluoro-iso-butyronitrile in a mixture with a dilution gas.

12. The circuit breaker according to claim 10, wherein the arc-control gas is a mixture of 2 molar percent (mol %) to 15 mol % heptafluoro-iso-butyronitrile, 60 mol % to 98 mol % carbon dioxide and 0 to 25 mol % oxygen.

13. A method for releasing heptafluoro-iso-butyronitrile into an arc-control gas of a medium- or high-voltage circuit breaker in use, the arc-control gas comprising heptafluoro-iso-butyronitrile in a mixture with a dilution gas, wherein the method consists in implementing a coating formed by a dielectric material obtained from a composition comprising a fluoropolymer matrix, at least one inorganic filler and microcapsules of liquid heptafluoro-iso-butyronitrile inside said medium- or high-voltage circuit breaker.

* * * * *